US006527463B2

(12) United States Patent
Miquel

(10) Patent No.: US 6,527,463 B2
(45) Date of Patent: Mar. 4, 2003

(54) PRINTER AND PRINT MEDIUM DRIVE SYSTEM

(75) Inventor: Antoni Gil Miquel, Barcelona (ES)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/765,509

(22) Filed: Jan. 19, 2001

(65) Prior Publication Data

US 2001/0010776 A1 Aug. 2, 2001

(30) Foreign Application Priority Data

Jan. 20, 2000 (EP) ..... 00101059

(51) Int. Cl.[7] ..... B41J 13/076; B41J 13/02
(52) U.S. Cl. ..... 400/634; 400/641
(58) Field of Search ..... 400/648, 659, 400/656, 658, 662, 636, 637, 637.1, 639, 639.1, 639.2, 641, 617, 625

(56) References Cited

U.S. PATENT DOCUMENTS 4,792,249 A * 12/1988 Lahr ..... 400/578
5,329,301 A * 7/1994 Balzeit et al. ..... 271/194
5,462,373 A * 10/1995 Chia ..... 271/114
5,813,782 A 9/1998 Mason ..... 400/636
5,816,720 A * 10/1998 Brannan et al. ..... 400/208
5,910,811 A * 6/1999 Sato ..... 347/104
6,270,071 B1 * 8/2001 Asada ..... 271/119
6,273,415 B1 * 8/2001 Tengo et al. ..... 271/109 Q
6,340,155 B1 * 1/2002 Madsen et al. ..... 198/471.1

FOREIGN PATENT DOCUMENTS

DE 4212900 A 10/1993
EP 0395887 A 11/1990
JP 02074371 A 3/1990

OTHER PUBLICATIONS

Bridge, S., European Search Report, completed on May 8, 2000, in the European Patent Office in Munich for application No. EP 00 10 1059.

* cited by examiner

*Primary Examiner*—Daniel J. Colilla

(57) ABSTRACT

To avoid the effects of unwanted variations in the pen-to-paper spacing of a printer, deliberate and effectively randomised variations are introduced by using paper drive rollers (20) with an irregular cross-section. In one embodiment, an overdrive roller comprises rollers (23–26) the surfaces of which incorporate flattened portions (27, 28) of differing widths and spacings. The number, size and/or spacing of the portions (27, 28) differ from roller to roller. Instead or in addition, variations may be incorporated into a pinch wheel (101), platen (15) or other component of the paper drive system.

14 Claims, 7 Drawing Sheets

PRINTER AND PRINT MEDIUM DRIVE SYSTEM

FIELD OF THE INVENTION

The present invention relates to printers, and especially to inkjet printers.

BACKGROUND OF THE INVENTION

A problem with such printers is that, when an absorbent print medium such as paper is being used, the medium has a tendency to move out of its plane. This movement up from the printing zone is caused by local expansion of the medium as it absorbs the printing ink and creates ruffles or cockle in the medium. Such movements cause variation of the pen-to-paper spacing (PPS) and have an adverse impact on image quality.

Another problem with such printers, which also affects PPS, is the creation of so-called "worms" due to the interaction of the print medium with paper-motion mechanisms. Print medium drive members, such as pinch wheels and overdrive wheels, act on the print medium at specific locations spaced along the scan axis of the printer. Thus they determine different boundary conditions at different locations across the print medium and this effect causes the medium to have a tendency to create ruffles at preferred scan-axis locations. The boundary conditions do not change with time and the resulting variations in PPS affect dot placement so that, in graphics applications, clearer areas or tracks (known as "worms") are observed extending along the paper axis. Such an impact on image quality is not acceptable.

The present invention seeks to overcome or reduce one or more of the above problems.

SUMMARY OF THE INVENTION

According to a first aspect of the present invention, there is provided a printer comprising a printhead and a print medium drive system for advancing a print medium past the printhead, the printhead being arranged to print on the medium in a plurality of successive print medium positions, characterised in that at least one component of the drive system is configured to exert different mechanical forces on the print medium in successive print medium positions.

The component may comprise one or more rollers or wheels with a non-circular periphery.

The component is preferably an overdrive roller arrangement.

According to a second aspect of the present invention, there is provided a print medium roller arrangement characterised in that it comprises one or more rollers having a drive surface with a non-circular periphery.

Alternatively the component may comprise a platen extending along the print axis and incorporating a plurality of suction holes, the platen incorporating a mechanism that selectively closes, at least partially, some of the holes.

According to a third aspect of the present invention, there is provided a printer platen comprising a plurality of suction holes and means for controlling the suction pressure applied by said holes, characterised in that said suction control means are arranged to apply different pressures to different ones of said holes at successive times.

BRIEF DESCRIPTION OF THE DRAWINGS

Preferred embodiments of the present invention will now be described, by way of example only, with reference to the accompanying drawings, in which:

FIG. 5*a* shows an overdrive arrangement for use in a printer according to another embodiment of the present invention.

DETAILED DESCRIPTION OF THE INVENTION

Figure 1:
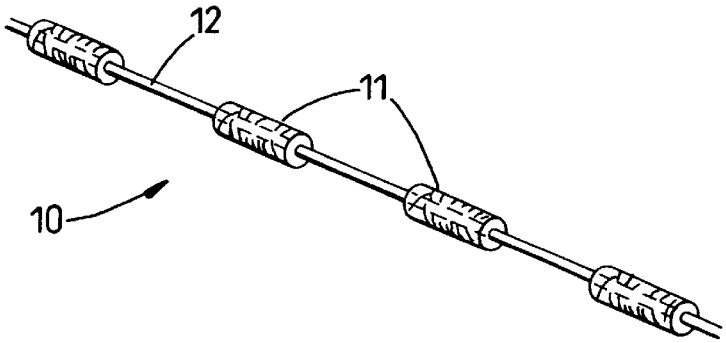
Fig. 1 Prior Art
FIG. 1 represents a conventional overdrive roller arrangement for a printer.

Referring to the drawings, FIG. 1 represents a conventional overdrive roller arrangement 10 (not to scale) comprising a plurality of spaced cylindrical rollers 11 attached to a rotatable shaft 12. A practical arrangement 10 is shown in the printer 100 of FIGS. 2 and 3 which also comprises printhead 50, pinch wheel 101, a central platen 15 with a suction aperture 17, and a drive roller 102 all defining the path for print medium 104.

Typical dimensions of the overdrive roller arrangement 10 are:

| | |
|---|---|
| diameter of shaft | 3 mm |
| length of roller | 15 mm |
| diameter of roller | 18.1 mm |
| centre-to-centre spacing of rollers | 76 mm. |

As the rollers 11 advance the print medium (not shown), they exert thereon mechanical forces, the pattern of which does not change from one print medium position to the next. Accordingly unwanted variations in PPS are produced and do not change over time.

Figure 2:
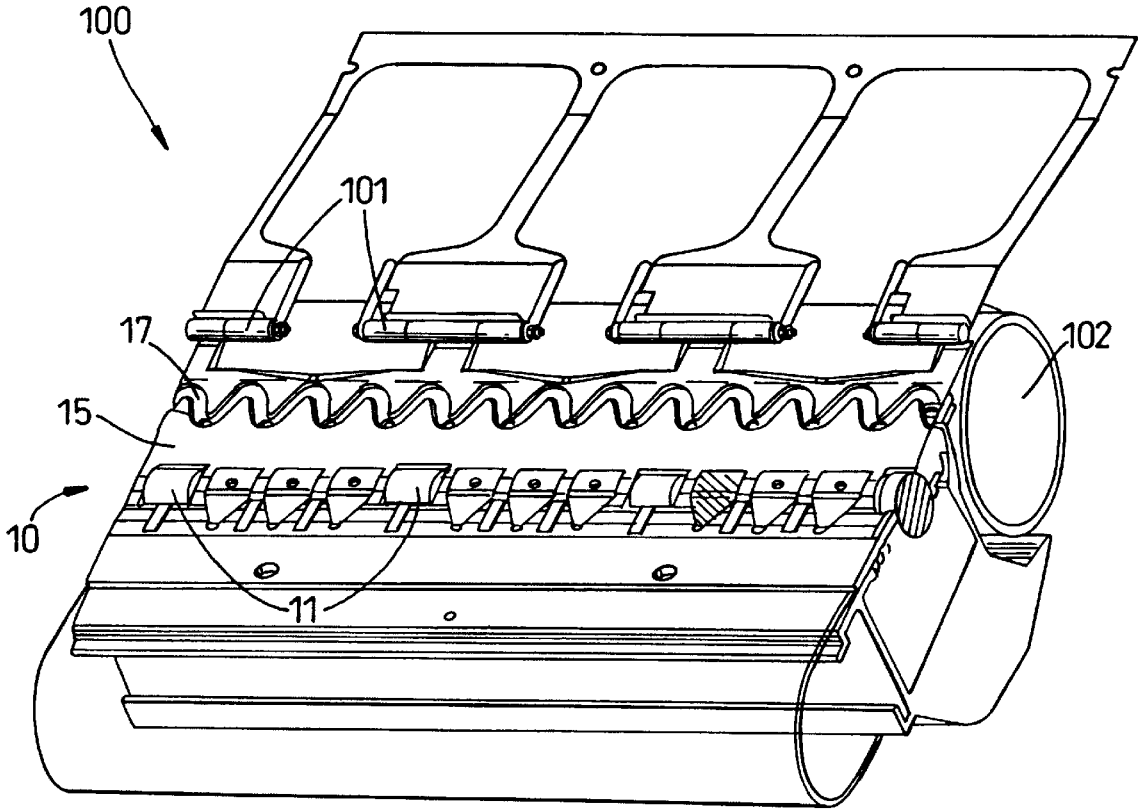
Fig. 2 Prior Art
FIG. 2 shows the printing region of an actual printer.
Figure 3:
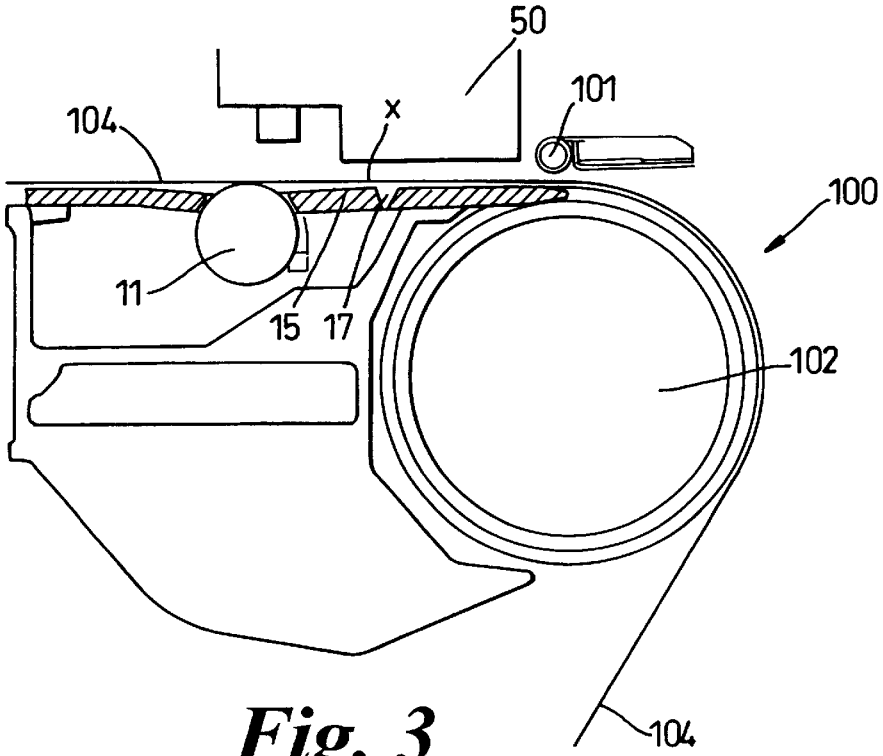
Fig. 3 Prior Art
FIG. 3 is an enlarged sectional view of part of FIG. 2 showing the printhead and the various rollers.
Figure 4A:
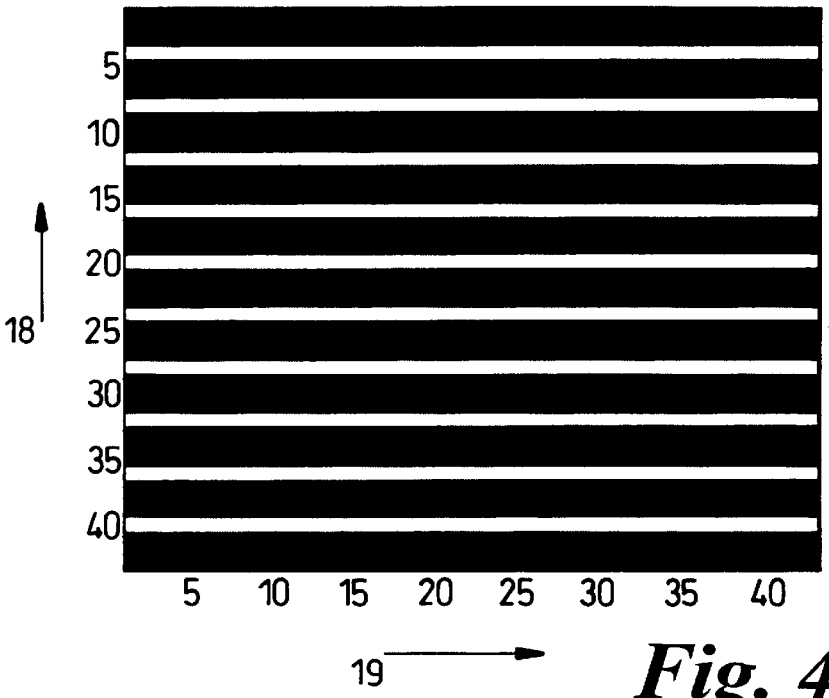
Fig. 4a Prior Art
FIGS. 4*a* and *b* are diagrams respectively illustrating the PPS along the line of the overdrive rollers and along a line spaced 2 cm from the line of these rollers.
Figure 4B:
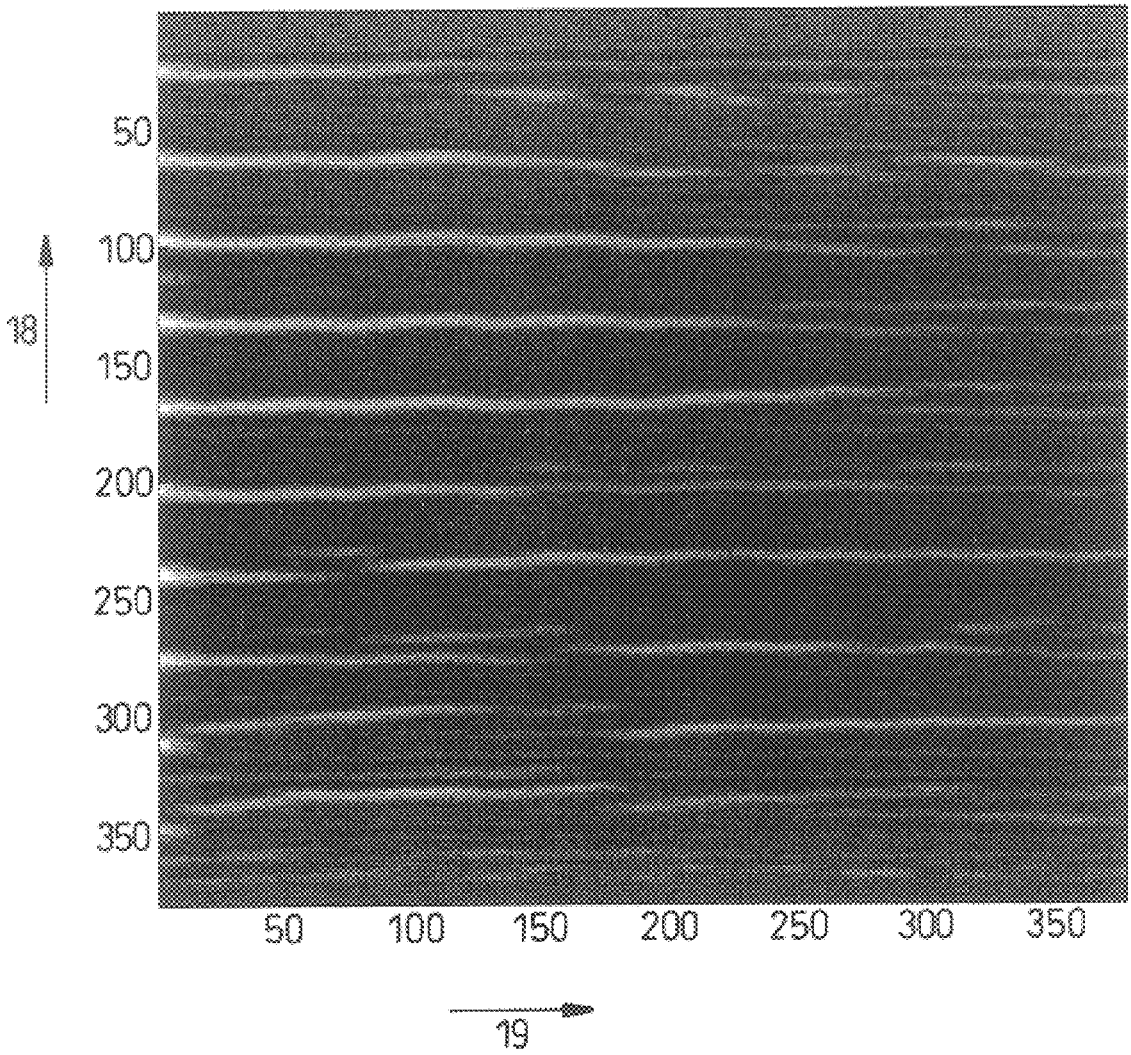
Fig. 4b Prior Art

FIGS. 2 and 3 show the relationship of the overdrive rollers 11 to central platen 15, the rollers protruding from below the substantially flat platen. FIG. 4*a* illustrates the PPS measured at the location of the rollers 11 themselves, with black portions representing essentially zero spacing and white portions representing approximately 1 mm spacing. Since the overdrive rollers are under the paper, the paper is sucked against the rollers, i.e. towards platen. FIG. 4*b* illustrates the PPS measured along a line located in the region of suction aperture 17, located 2 cm away from the shaft 12. The position of the line is indicated by "x" in FIG. 3. In FIGS. 4*a* and *b* arrow 18 represents the scan (or printing) axis and arrow 19 represents the paper advance axis. The unwanted PPS crests can be seen (indicated in white) corresponding to the locations of the overdrive rollers. Stronger crests are produced near the cut edge of the paper. As soon as the paper advances enough as to curl down, crests diminish, though they remain troublesome. There are, therefore, a transient situation and a steady state situation.

The present invention is based on the realisation that it is not necessary to eliminate variations in PPS to reduce the impact on image quality. Rather, by breaking the symmetry which was previously maintained along the paper axis, it is possible to effectively randomise the variations in PPS and thus to substantially reduce or eliminate "worms" and other such printing artefacts.

Figure 5:
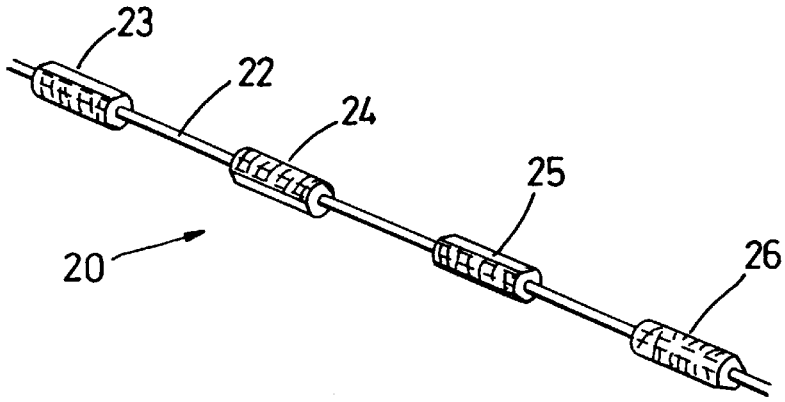
Fig. 5 Prior Art
FIG. 5 shows an overdrive arrangement for use in a printer according to a first embodiment of the present invention.
Figure 6:
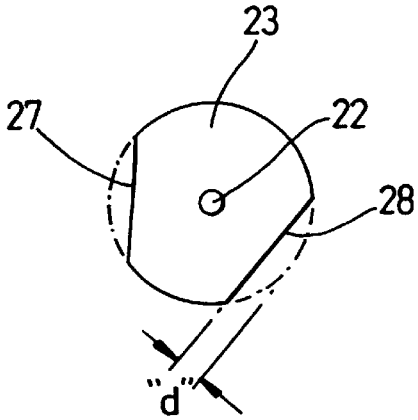
Fig. 6 Prior Art
FIG. 6 shows the cross-section on an enlarged scale of a roller of the arrangement of FIG. 5.

Referring now to FIGS. 5 and 6, there is shown an overdrive roller arrangement 20 in accordance with the present invention comprising a plurality of spaced rollers 23, 24, 25, 26 attached to a rotatable shaft 22. Each roller has a surface 30 of generally circular cross-section of radius 9.05 mm but has one or more flat surfaces 27, 28 extending along its entire length and spaced around its circumference or periphery. The maximum cut depth "d" of the flat surfaces is typically 1.5 to 3.5 mm and the angle therebetween may be selected as desired. The combination of the number, width and spacing of the flat surfaces are selected differently for each roller 23–26 to introduce a further randomising factor into the PPS across the print medium.

Figure 7A:
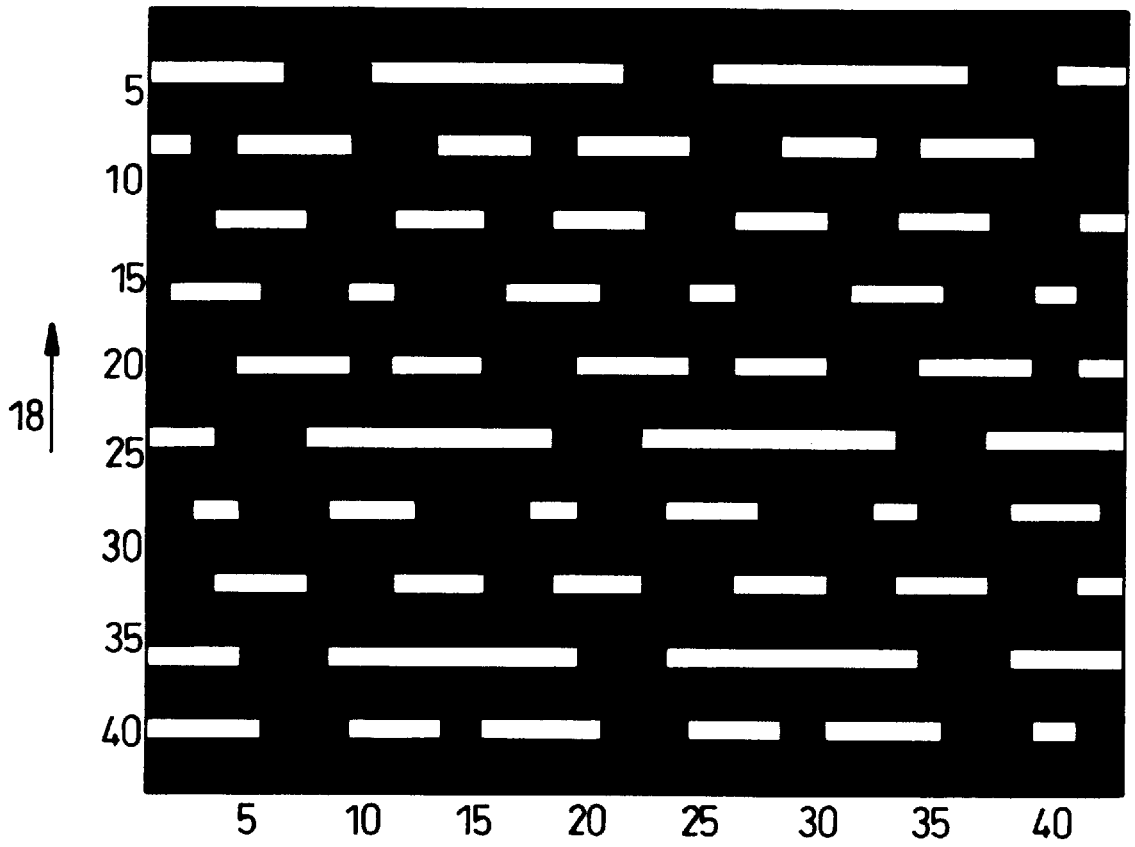
Fig. 7a Prior Art
FIGS. 7*a* and *b* are diagrams corresponding to FIGS. 4*a* and *b*, but relating to the overdrive arrangement of FIG. 5.

As the print medium advances, a different profile of mechanical forces is exerted thereon from one print medium position to the next position after an advance movement. Thus the PPS is different for every position of the print medium. With the conventional arrangement of FIG. 1 there is always constructive interference which produces defects in the image quality. With the arrangement of FIGS. 5 and 6 there is random interference, occasionally constructive but predominantly destructive, and this produces a different visual effect, which is more pleasing to the eye. This can be seen in FIGS. 7*a* and 7*b* which correspond to FIGS. 4*a* and 4*b*. The effect of the interruptions caused by flat surfaces 27 and 28 in the circumferences of the rollers 11 can be seen in the differing patterns shown in FIG. 7*a*.

Figure 7B:
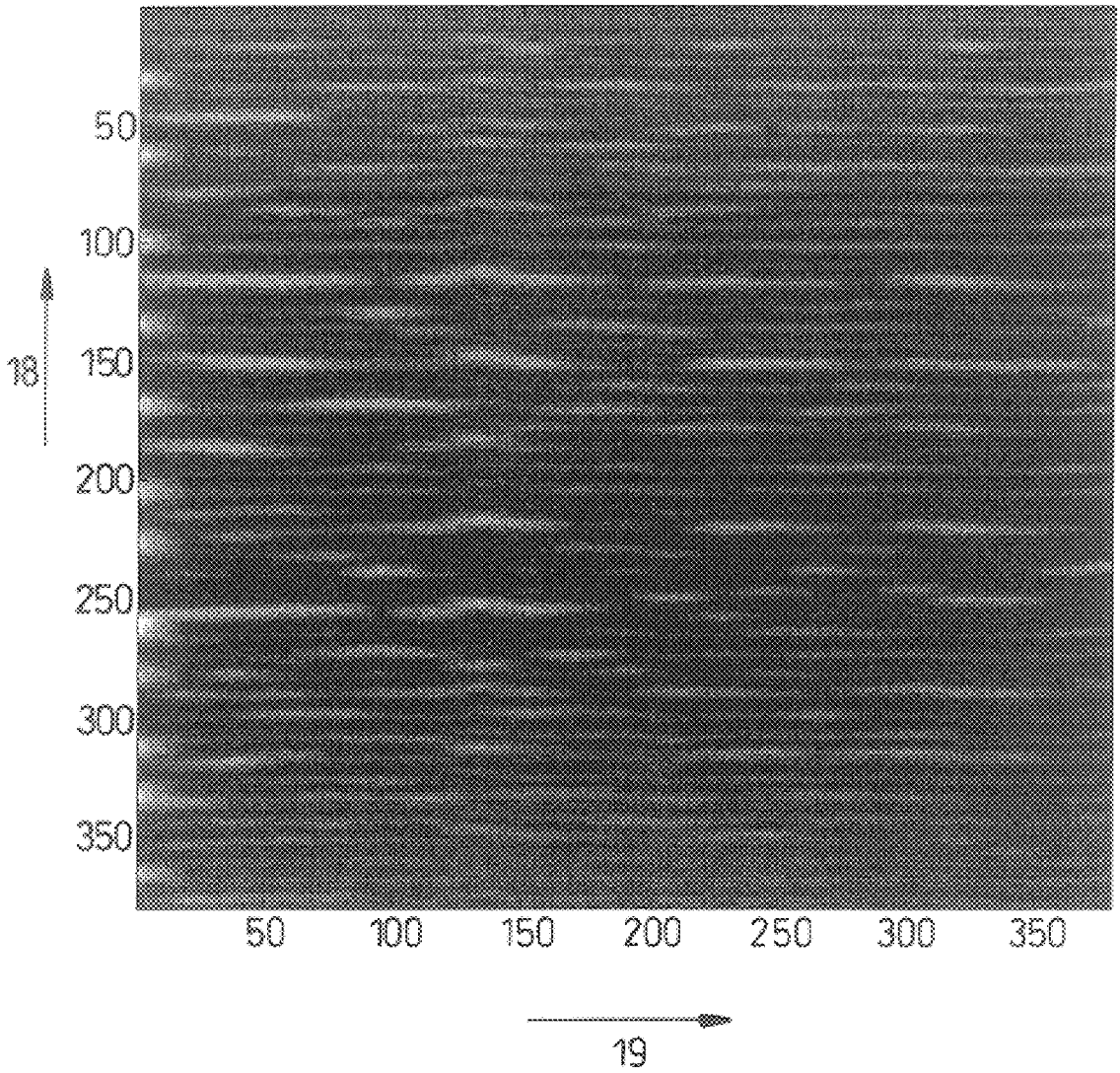
Fig. 7b Prior Art

As can be seen indicated in white in FIG. 7*b*, the PPS crests still exist, but they are interrupted and much less evident than in FIG. 4*b*.

Another advantage of the arrangement of FIGS. 5 and 6 is that it is possible to compensate for errors or defects, the size of which is comparable with the dimensions of the entire printing zone. With other methods, e.g. the use of printing masks, there can be corrected only errors, the size of which is comparable to the dimensions of the printhead.

Various modifications may be made to the above-described arrangement. For example, the rollers 23 to 26 may have one or three or a greater number of flat surfaces. Some of the flat surfaces 27, 28 may directly adjoin each other so that part of the roller has a polygonal cross-section. As shown in Figure 5*a*, another overdrive arrangement 20*a* may include example rollers 23*a* and 24*a*, where one or more of the flat surfaces 27, 28 may be replaced by a curved surface having a radius of curvature greater than that of the rest of the respective roller.

Any convenient number of rollers may be provided on shaft 22.

Although the arrangement of FIG. 5 has different rollers 23–26, some of them may be identical since this will still have the effect of reducing "worms" extending along the paper axis. It is preferable that the circumference or peripheral dimension of the rollers does not equal the amount of a print medium advance and is not a multiple or factor thereof. This avoids the introduction of unwanted artefacts and provides a further randomising effect.

One or more of the rollers may have a conventional circular cross-section, but such an arrangement is not as effective.

Although described in connection with an overdrive roller arrangement, the changes in configuration may be introduced, instead or in addition, into other paper-drive components such as pinch-wheels 101. The component may be an elongate roller which has variations in cross-section along its length in addition to around its circumference. If desired, an additional set of wheels or rollers may be incorporated in a printer, specifically to introduce the controlled variations in PPS and thus dot placement.

An advantage of introducing variations into two or more components of the print drive system is that a further randomising factor is introduced into the PPS. The radii of rotating components are preferably different and one is preferably not a multiple of the other. This avoids the introduction of unwanted artefacts and provides yet a further randomising effect.

In a further arrangement, the paper path can include a centre platen with a plurality of suction/vacuum holes arranged to retain the paper against the platen and having a mechanism that moves to close different ones of said holes during successive printing passes.

Figure 8A:
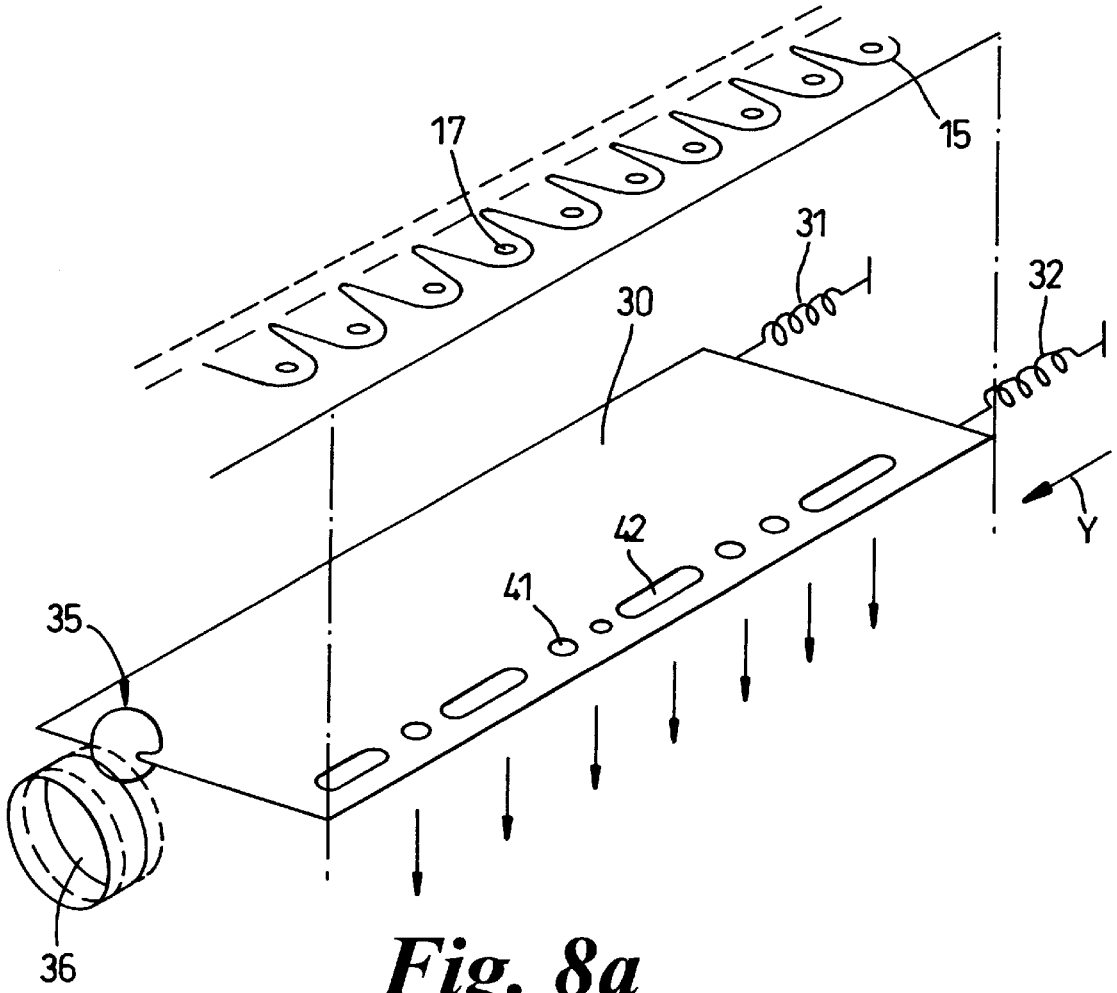
Fig. 8a Prior Art
FIG. 8*a* is a schematic perspective view of a vacuum platen arrangement for use in a printer according to a second embodiment of the present invention.

Thus, in a second embodiment of the invention, FIGS. 8*a* and *b*, a member 30 of sheet material is provided beneath the central platen 15. Member 30 has a bearing element 35 at one end and is connected at the other end to the printer chassis by compression springs 31, 32 which use the bearing element 35 in the direction of arrow "y" against a cam wheel 36. Bearing element 35 engages a cam surface (not shown) of wheel 36. Wheel 36 is geared to the paper advance mechanism of the printer.

Member 30 has a plurality of irregularly sized and spaced holes and slots 41, 42 arranged in a line which extends beneath the suction apertures 17 in the platen 15, so that suction is applied to the lower surface of the paper via both sets of openings 17 and 41, 42.

Figure 8B:
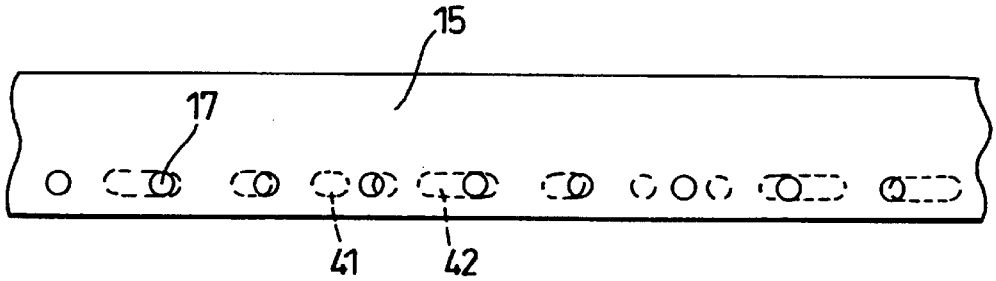
Fig. 8b Prior Art
FIG. 8*b* is a partial top view of the platen of FIG. 8*a*.

In use, wheel 36 undergoes a certain rotation each time the paper (or other print medium) is advanced so that the cam surface causes member 30 to move to another position along the print axis. Holes and slots 41, 42 thus adopt another relative disposition to apertures 17 and thus, as will be appreciated from FIG. 8*b*, a different pattern of suction is exerted on the paper. This causes the vacuum pressure to vary over time at different locations. To increase the randomising effect, it is arranged that a single paper advance movement does not produce an integral number of rotations of the wheel 36, nor does a single rotation of wheel 36 correspond to an integral number of paper advance movements.

In a modification the paper path includes a platen, the surface of which is flexible and has a profile which is altered over time by an underlying control mechanism.

What is claimed is:

1. A printer comprising a printhead and a print medium drive system for advancing a print medium past the printhead to define a plurality of successive print medium positions spaced apart in the direction of said print medium advance, said printhead being arranged to print on said medium along a scan axis successively at each of said print medium positions, said drive system including at least one component configured to engage said print medium at a plurality of locations along said scan axis, wherein, at each of said plurality of locations, said component exerts different mechanical forces on said print medium in successive ones of said print medium positions, and said at least one component is configured differently at different ones of said plurality of locations along said scan axis.

2. A printer according to claim 1, wherein said at least one component comprises a respective roller at each of said plurality of locations, each of said rollers having a non-circular periphery.

3. A printer according to claim 2, wherein each of said rollers has a generally circular periphery interrupted by one or more non-circular portions.

4. The printer according to claim 3, wherein the non-circular portions are substantially flat.

5. A printer according to claim 3, wherein the width of the non-circular portion of each of said rollers differs from the width of the non-circular portion of each other roller.

6. A printer according to claim 3, wherein each of said rollers comprises a plurality of non-circular portions and wherein spacings between said non-circular portions of each of said rollers differs from spacings between the non-circular portions of each other roller.

7. A printer according to claim 3. wherein each of said rollers have different numbers of non-circular portions.

8. A printer according to claim 2, wherein the print medium undergoes substantially equal advance movements between the successive print medium positions, and wherein a circumferential dimension of each of said rollers does not equal the amount of said advance movement and is not a multiple or a factor thereof.

9. A printer according to claim 1, wherein said at least one component is an overdrive roller arrangement.

10. A printer according to claim 1, wherein said at least one component is a pinch wheel arrangement.

11. A printer according to claim 1, wherein said at least one component is a platen of the print medium drive system, the platen having a flexible surface with a profile, said profile varying with time.

12. A printer according to claim 1, comprising two or more of said components, said two or more components being configured to exert different mechanical forces on the print medium in successive print medium positions.

13. A printer according to claim 12, wherein said two or more components include two rotating components the radii of which are different and not a multiple one of the other.

14. A printer according to claim 1, wherein said at least one component is a platen of the print medium drive system, said platen having a longitudinal axis and comprising a plurality of suction holes placed along said longitudinal axis, and means for varying the suction pressure applied through said holes, said suction varying means being arranged to apply different pressures to each of said holes at successive times, and said suction varying means also being arranged to apply different patterns of suction at different ones of said holes.

* * * * *

UNITED STATES PATENT AND TRADEMARK OFFICE

CERTIFICATE OF CORRECTION

PATENT NO. : 6,527,463 B2 
DATED : March 4, 2003
INVENTOR(S) : Antoni Gil Miquel It is certified that error appears in the above-identified patent and that said Letters Patent is hereby corrected as shown below:

Title page, Item [54] and Column 1, lines 1 and 2,
Please change the title from "PRINTER AND PRINT MEDIUM DRIVE SYSTEM" to -- PRINTERS --.

Signed and Sealed this

Eighth Day of July, 2003

JAMES E. ROGAN
*Director of the United States Patent and Trademark Office*